US005415481A

United States Patent [19]

Nakashima et al.

[11] Patent Number: 5,415,481

[45] Date of Patent: May 16, 1995

[54] FEEDING OF INK RIBBON BASED ON SHAPES OF A PLURALITY OF PREVIOUSLY PRINTED CHARACTERS

[75] Inventors: Takashi Nakashima, Yamatokoriyama; Ichiro Nakamura, Nara, both of Japan

[73] Assignee: Sharp Kabushiki Kaisha, Osaka, Japan

[21] Appl. No.: 184,595

[22] Filed: Jan. 21, 1994

[30] Foreign Application Priority Data

Jan. 25, 1993 [JP] Japan ..... 5-010140

[51] Int. Cl.[6] ..... B41J 33/36

[52] U.S. Cl. ..... 400/232; 400/225

[58] Field of Search ..... 400/208, 225, 232, 227

[56] References Cited

U.S. PATENT DOCUMENTS 4,558,965 12/1985 Ueda et al. ..... 400/144.2
4,787,763 11/1988 Kondo ..... 400/232
4,981,376 1/1991 Oku ..... 400/225

FOREIGN PATENT DOCUMENTS 3820901 1/1989 Germany ..... 400/225
215080 9/1986 Japan ..... 400/208
62-21575 1/1987 Japan ..... 400/225
152890 7/1987 Japan ..... 400/232

OTHER PUBLICATIONS

Patent Abstracts of Japan, vol. 10, No. 146 (M-482) [2203], May 28, 1986, abstracting Umemura application 61-2581-A, published 8 Jan. 1986.

Patent Abstracts of Japan, vol. 11, No. 269 (M-621) [2716], Sep. 2, 1987, abstracting Murakami/N. E. C. application 62-71687-A, published 2 Apr. 1987.

Partial translation of Japanese laid-open application 62-152 890 (ref. M on PTO-892).

*Primary Examiner*—David A. Wiecking
*Assistant Examiner*—Steven S. Kelley
*Attorney, Agent, or Firm*—David G. Conlin; George W. Neuner; Milton Oliver

[57] ABSTRACT

A traveling amount calculating unit calculates a minimum traveling amount of a printing transfer material required for a plurality of shapes printed previously not overlying a shape to be printed next on the printing transfer material. Based on the traveling amount, a traveling unit travels the printing transfer material. Then, a transfer unit transfers a shape to be printed next.

17 Claims, 9 Drawing Sheets

FIG. 6

| | | SECOND CHARACTER | | | | | |
|---|---|---|---|---|---|---|---|
| | | A | B | C | D | E | . . . |
| FIRST CHARACTER | A | 16 | 12 | 32 | 11 | . . . | . . . |
| | B | 25 | 18 | . . . | . . . | | |
| | C | 43 | . . . | . . . | | | |
| | D | . . . | . . . | | | | |
| | E | . . . | | | | | |
| | ⋮ | | | | | | |

FEEDING OF INK RIBBON BASED ON SHAPES OF A PLURALITY OF PREVIOUSLY PRINTED CHARACTERS

BACKGROUND OF THE INVENTION

1. Field of the Invention

The present invention generally relates to printing apparatuses carrying out printing with a printing transfer material, and more particularly, to an electronic typewriter or the like which carries out printing with an ink ribbon or the like.

2. Description of the Background Art

Description will be given of an electronic typewriter which is a conventional printing apparatus with reference to the drawings. FIG. 12 is a schematic diagram of a printing mechanism of the electronic typewriter. The printing mechanism includes a platen 20, a print wheel 22, and a hammer solenoid 17. A papersheet 27 on which printing is carried out is wound around a cylindrical surface of platen 20. Between platen 20 and hammer solenoid 17, provided is print wheel 22 having a projection of a predetermined character shape at its tip. Between print wheel 22 and papersheet 27, disposed is an ink ribbon 21 serving as a printing transfer material. The printing operation by the printing mechanism is as follows. Hammer solenoid 17 travels in the direction of the arrow so that print wheel 22 presses platen 20 though ink ribbon 21 and papersheet 27. At this time, since the projection of print wheel 22 is strongly pressed, ink on ink ribbon 21 corresponding to the shape of the projection is transferred onto papersheet 27, and the predetermined character shape is printed. Then, a carriage (not shown) having print wheel 22, hammer solenoid 17, and ink ribbon 21 mounted thereon travels by one character space in the vertical direction of the figure. At this time, ink ribbon 21 is fed by one character space on the carriage. Then, as described above, hammer solenoid 17 operates so that the next character is printed.

In the conventional printing apparatus structured as described above, an ink ribbon was displaced by a predetermined space al for every printing of one character, part of the ink ribbon remained unused between respective characters printed, resulting in ineffective use of the ink ribbon. FIG. 13 shows one example of use of the ink ribbon. The white portion in the figure shows a transparent portion on which ink is transferred onto a papersheet, and a hatching portion shows the ink ribbon having ink left. As is clear from the figure, the ink ribbon is left unused between characters. Respective characters might be printed more closely.

As a method for solving the above problem, a method is employed of setting a predetermined PS (Proportional Spacing) pitch for each character and displacing an ink ribbon by a PS pitch corresponding to each character. FIG. 14 shows one example of a state where the ink ribbon is used for printing by this method. a2 is a PS pitch corresponding to +, and a3 is a PS pitch corresponding to =. As shown in the figure, each character is printed with the left side portion printed closely. The ink ribbon is used more effectively than in the conventional method. However, since an unused portion of the precedingly printed character is not considered, effective use of the ink ribbon cannot be implemented completely.

SUMMARY OF THE INVENTION

One object of the present invention is to provide a printing apparatus which can make effective use of a printing transfer material completely.

The printing apparatus according to the present invention includes a transfer unit transferring a predetermined shape from a printing transfer material, a traveling amount calculating unit calculating such a traveling amount of the printing transfer material that a shape precedingly transferred by the transfer unit does not overlie a shape to be transferred next on the printing transfer material, and a traveling unit traveling the printing transfer material with respect to the transfer unit based on the traveling amount calculated by the traveling amount calculating unit.

The printing apparatus according to the present invention displaces the printing transfer material with respect to the transfer unit by the minimum traveling amount required for a shape precedingly transferred not overlying a shape to be transferred next on the printing transfer material to transfer the shape to be transferred next. As a result, the printing apparatus of the present invention can make effective use of the ribbon or other transfer material completely.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is a space table stored in a ROM of a memory portion of the printing apparatus of one embodiment of the present invention.

DESCRIPTION OF THE PREFERRED EMBODIMENTS

Description will now be given of the printing apparatus of one embodiment of the present invention with reference to the drawings.

Figure 2:
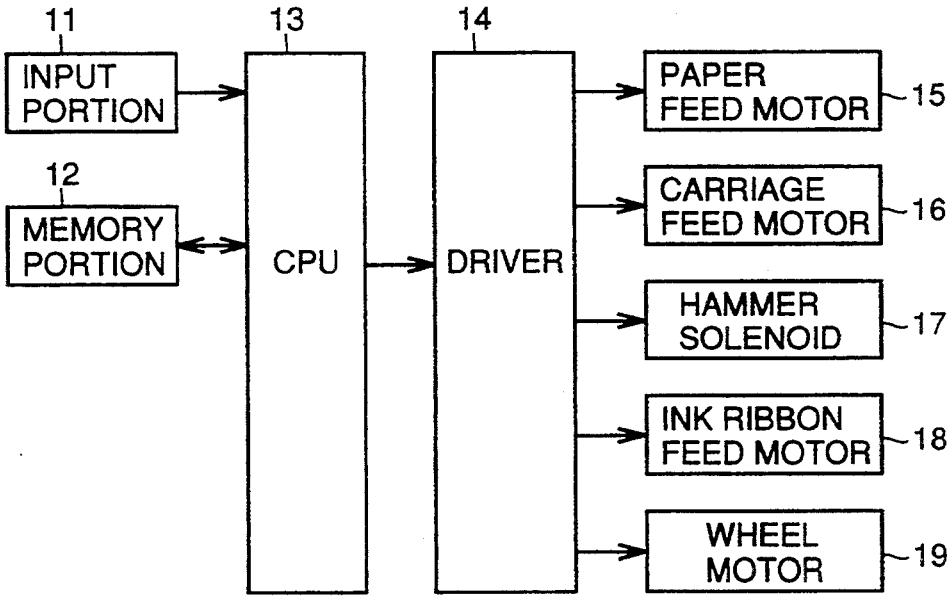
FIG. 2 is a block diagram of the printing apparatus according to one embodiment of the present invention.

Referring to FIG. 2, the printing apparatus includes an input portion 11, a memory portion 12, a CPU (Central Processing Unit) 13, a driver 14, a paper feed motor 15, a carriage feed motor 16, a hammer solenoid 17, an ink ribbon feed motor 18, and a wheel motor 19. Input portion 11 is configured of various keys, through which a predetermined character, an operational instruction of the device, or the like are input. Memory portion 12 is configured of an ROM (Read Only Memory), an RAM (Random Access Memory) or the like. Various programs for systematically controlling the device, a space table to be described later, or the like are stored in the ROM in advance, and necessary data such as history of characters previously printed is stored in the RAM. CPU 13 reads out a predetermined program from memory portion 12, controls each portion systematically based on information input from input portion 11, and carries out various operations required for printing. Based on the results, CPU 13 gives various control instructions to driver 14. In response to the instructions, driver 14 drives and controls paper feed motor 15, carriage feed motor 16, hammer solenoid 17, ink ribbon feed motor 18, and wheel motor 19 so that predetermined operations are carried out.

Figure 3:
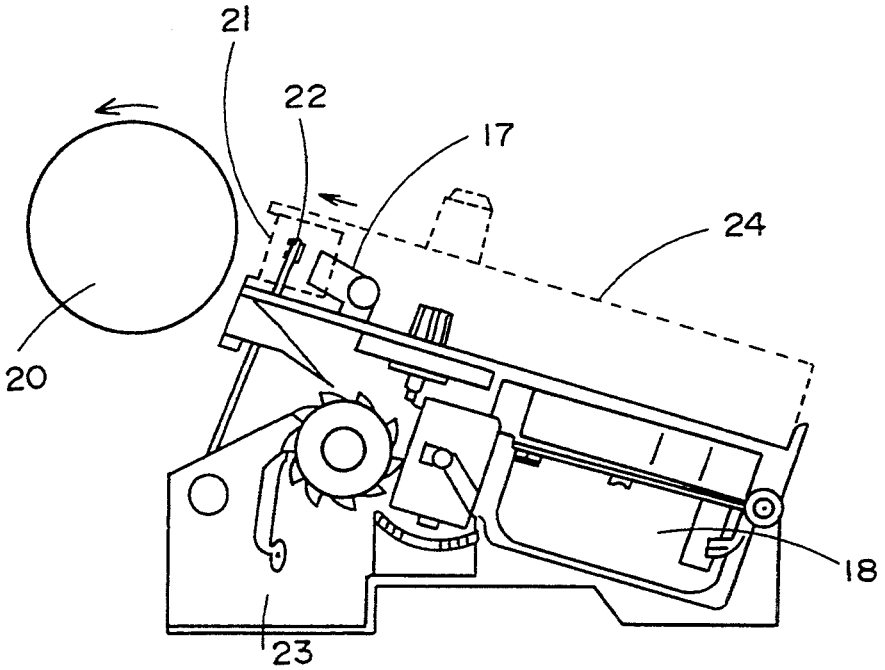
FIG. 3 is a schematic diagram of a printing mechanism of the printing apparatus of one embodiment of the present invention.

A schematic description will now be given of the printing apparatus. As shown in FIG. 3, the printing apparatus includes platen 20, print wheel 22, hammer solenoid 17, ink ribbon feed motor 18, and a carriage 23. An ink ribbon cassette 24 is set on carriage 23, and ink ribbon 21 is disposed between platen 20 and print wheel 22. A papersheet on which printing is to be carried out (not shown) is set between ink ribbon 21 and platen 20. Print wheel 22 has a plurality of projections of predetermined character shapes formed at its tip. Platen 20 is rotated in the direction of the arrow by paper feed motor 15 shown in FIG. 2 to feed out the papersheet on which printing is carried out for each line. Hammer solenoid 17 travels in the direction of the arrow so that print wheel 22 is pressed against platen 20. Ink ribbon feed motor 18 travels ink ribbon 21 by a predetermined traveling amount in the vertical direction of the figure. Carriage 23 is traveled by a predetermined traveling amount in the vertical direction of the figure by carriage feed motor 16. Print wheel 22 is rotated by wheel motor 19 of FIG. 2 to position a predetermined character between hammer solenoid 17 and platen 20.

Figure 4:
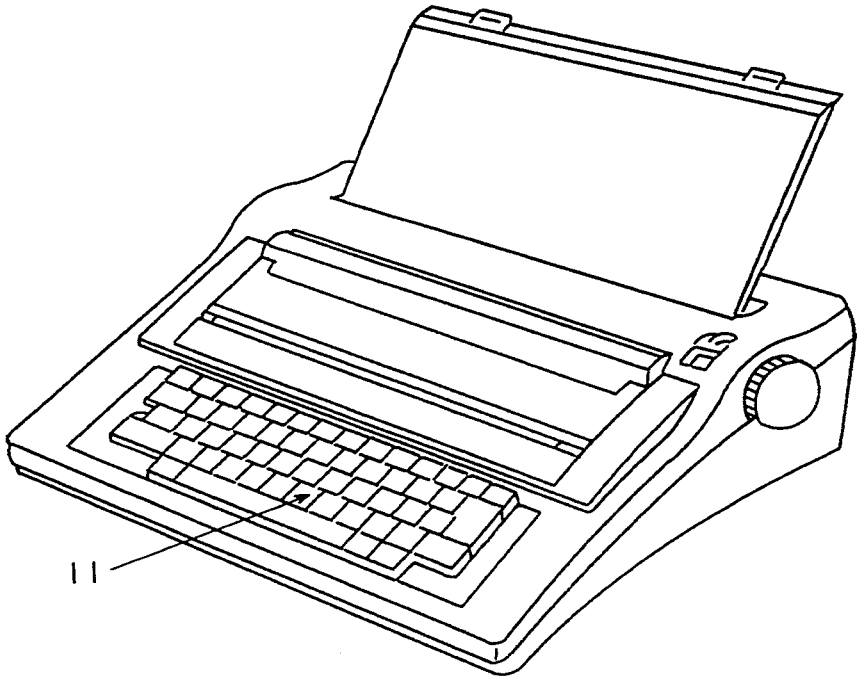
FIG. 4 is a diagram showing the appearance of the printing apparatus of one embodiment of the present invention.

Description will now be given of an electronic typewriter which is a printing apparatus structured of the above hardware. As shown in FIG. 4, input portion 11 includes various keys. By the user pressing these keys, various kinds of information is input so that a predetermined character can be printed by each component included in the apparatus.

Figure 1:
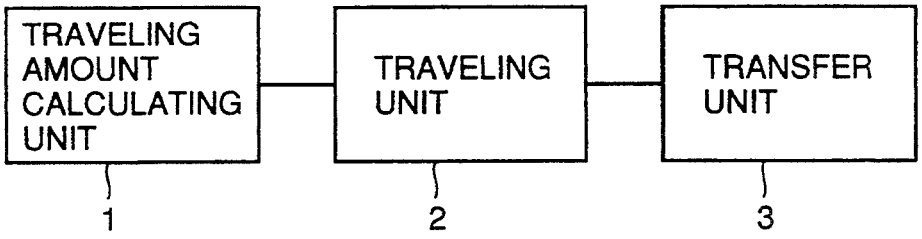
FIG. 1 is a functional block diagram explaining a structure of a printing apparatus according to one embodiment of the present invention.

The printing apparatus of the present invention structured as described above will now be described functionally. As shown in FIG. 1, the printing apparatus includes a traveling amount calculating unit 1, a traveling unit 2, and a transfer unit 3. Traveling amount calculating unit 1 includes CPU 13, memory portion 12, and the like. Traveling amount calculating unit 1 calculates such a minimum traveling amount of ink ribbon 21 that a character precedingly printed does not overlap a character to be printed next on ink ribbon 21. Traveling unit 2 includes CPU 13, driver 14, ink ribbon feed motor 18, and the like. Traveling unit 2 travels ink ribbon 21 based on the traveling amount calculated by traveling amount calculating unit 1. Transfer unit 3 includes CPU 13, driver 14, paper feed motor 15, carriage feed motor 16, hammer solenoid 17, wheel motor 19, and the like. Transfer unit 3 prints a predetermined character on a papersheet. After printing of one character, transfer unit 3 travels carriage 23 by a traveling amount for one character and travels the papersheet on which printing is carried out by one line after printing for one line is completed. As a result, characters are printed on the papersheet with a predetermined space, while ink ribbon 21 is used with the minimum space required for printed characters not overlapping each other, resulting in completely effective use of ink ribbon 21.

Figure 5:
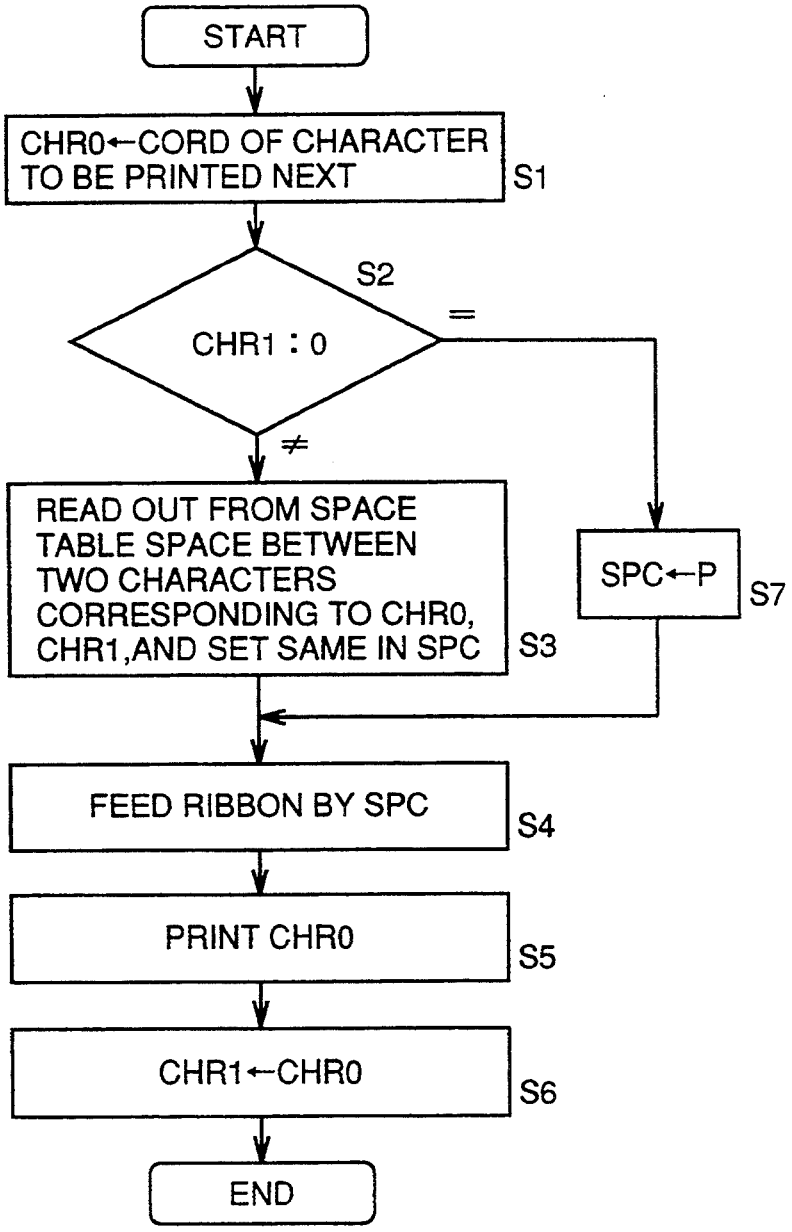
FIG. 5 is a flow chart of a first printing method using the printing apparatus of one embodiment of the present invention.

Description will now be given of a printing method using the apparatus of the present invention with reference to FIG. 5. The procedure of the flow chart of FIG. 5 is implemented by CPU 13 reading out a predetermined program from the ROM of memory portion 12 to carry out each processing.

At step S1, CPU 13 stores a code of a character to be printed next input from input portion 11 or read out from memory portion 12 in the RAM of memory portion 12 as a value of a variable CHR0. Then, at step S2, CPU 13 confirms that effective data is stored in a variable CHR1 in which a code of a character printed immediately before is stored. A character code other than 0 is generally stored in CHR1, and 0 is stored when the stored data is not effective. CHR1 is 0, immediately after power-on, immediately after exchange of ink ribbon cassettes 24, immediately after exchange of print wheels 22, or the like. CPU 13 stores 0 in CHR1 under these conditions. After confirmation, the procedure goes to step S7 when CHR1 is 0. The procedure goes to step S3 when CHR1 is a character code other than 0.

When CHR1 is a character code other than 0, at step S3, CPU 13 calculates, based on a character code to be printed next stored in CHR0 and a character code printed immediately before stored in CHR1, such a minimum feeding amount that these two characters do not overlie each other on ink ribbon 21. The feeding amount is stored in a space table shown in FIG. 6. The space table is stored in the ROM of memory portion 12 in advance for every character combination used. The first character of the ordinate of FIG. 6 shows an immediately precedingly printed character stored in CHR1, and the second character of the abscissa shows a character to be printed next stored in CHR0. CPU 13 reads out a feeding amount of ink ribbon 21 corresponding to CHR1, CHR0 of the space table, and sets the feeding amount to a variable SPC.

On the other hand, when CHR1 is 0, and does not store effective data, an ordinary feeding amount P for one character is stored in SPC, at step S7, since CPU 13 cannot specify a character printed immediately before.

After completion of the processing of steps S3 and S7, at step S4, CPU 13 provides driver 14 with instructions to feed ink ribbon 21 by the feeding amount stored in SPC. In response to the instructions, driver 14 drives ink ribbon feed motor 18 to feed ink ribbon 21 by a predetermined feeding amount.

Then, at step S5, CPU 13 provides driver 14 with instructions of the amount of rotation of wheel motor 19 in order to read out the character code stored in CHR0, and to set print wheel 22 of a character corresponding to the character code. In response to the instructions, driver 14 drives wheel motor 19 to adjust print wheel 22 at a predetermined position. Then, CPU 13 provides driver 14 with the instructions to drive hammer solenoid 17 for printing. Driver 14 drives hammer solenoid 17. A character shape at the tip of print wheel 22 is transferred onto a papersheet on which printing is carried out from ink ribbon 21, and printing is completed.

Finally, at step S6, in order to prepare for the next printing, CPU 13 stores in CHR1 the character code stored in CHR0.

According to the above operation, it is possible to print characters with ink ribbon 21 fed by the minimum feeding amount required for a precedingly printed character not overlying a character to be printed next on ink ribbon 21.

A printing method considering all of the maximum M characters printed precedingly will now be described with reference to flow charts of FIGS. 7 to 9 as a second printing method of the present invention. Similar to the case of the first printing method, in the second printing method, each processing is carried out by CPU 13 reading out a predetermined program from the ROM of memory portion 12.

Figure 7:
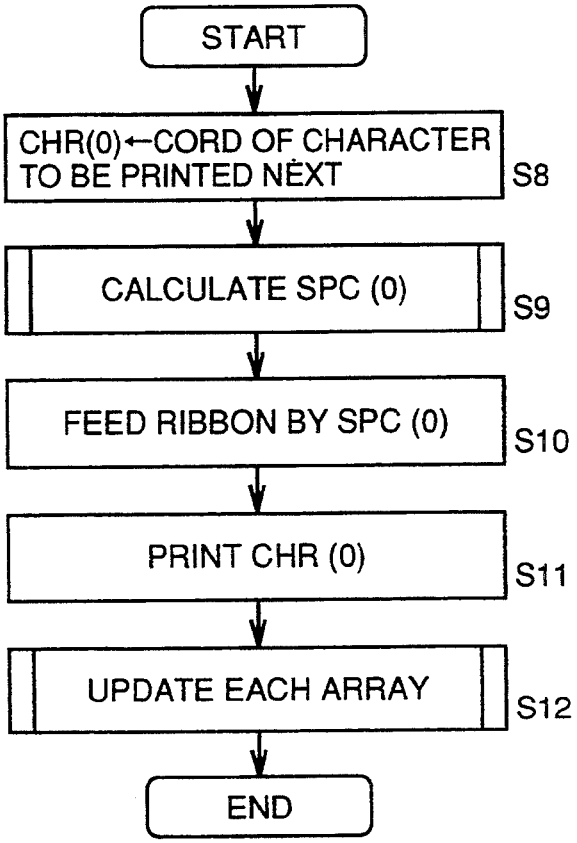
FIG. 7 is a flow chart of a main routine of a second printing method using the printing apparatus of one embodiment of the present invention.

At step S8 of FIG. 7, CPU 13 stores a character code to be printed next input from input portion 11 or read out from memory portion 12 in array CHR (0).

Figure 8:
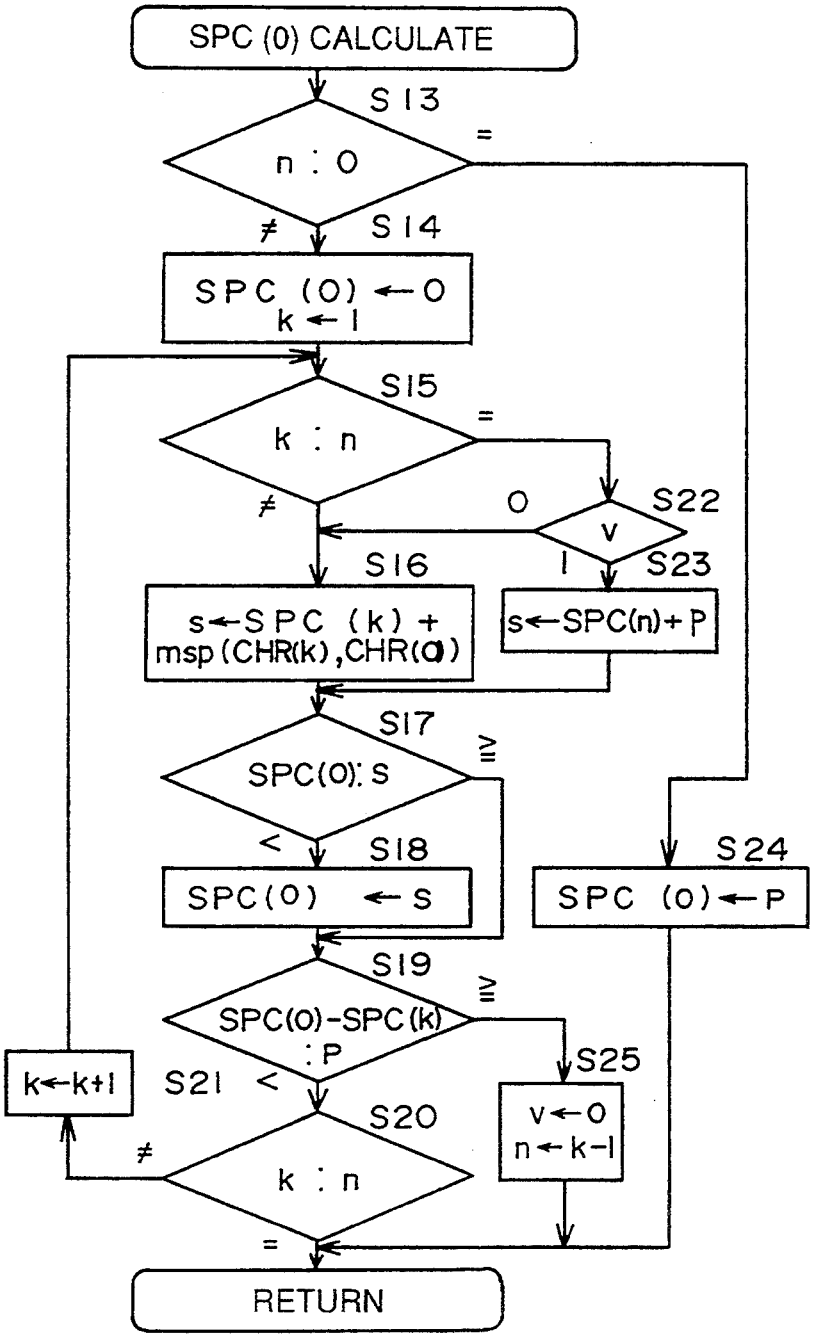
FIG. 8 is a flow chart of an SPC (0) calculation subroutine of the second printing method using the printing apparatus of one embodiment of the present invention.

Then, at step S9, CPU 13 calls an SPC (0) calculation routine of FIG. 8. In the SPC (0) calculation routine, as will be described later, the minimum feeding amount of ink ribbon 21 required for maximum M characters printed precedingly not overlying a character to be printed next on ink ribbon 21 is stored in array SPC (0).

At step S10, CPU 13 reads out the feeding amount stored in SPC (0), carries out the processing similar to that of step S4 of FIG. 5, and feeds ink ribbon 21 by a predetermined feeding amount.

Then, at step S11, CPU 13 reads out the character code stored in CHR (0), carries out the processing similar to that of step S5 of FIG. 5, and prints a character corresponding to the character code stored in CHR (0).

Figure 9:
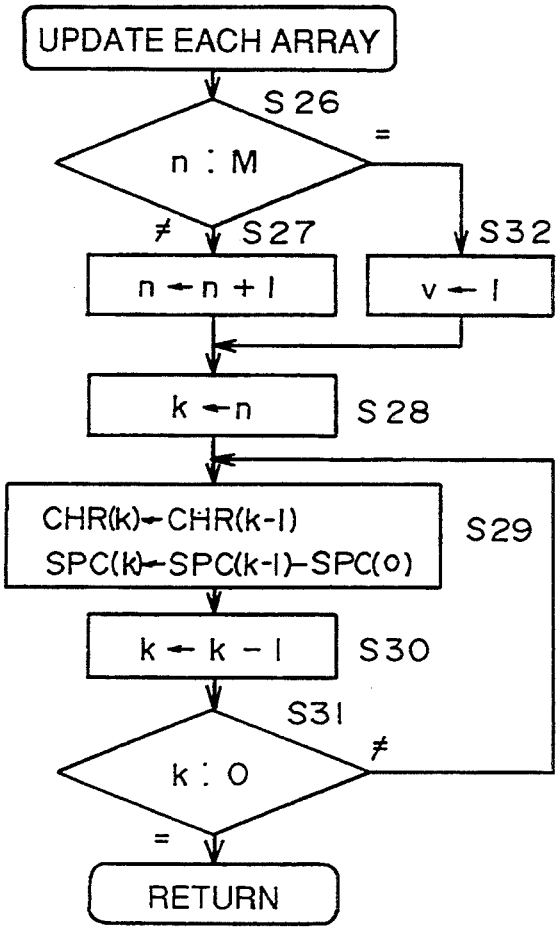
FIG. 9 is a flow chart of each array update subroutine of the second printing method using the printing apparatus of one embodiment of the present invention.

Finally, at step S12, CPU 13 calls each array update routine of FIG. 9. In each array update routine, as will be described later, each array and variable are updated in order to prepare for the next printing.

The SPC (0) calculation processing will now be described with reference to the flow chart of FIG. 8.

In response to the SPC (0) calculation subroutine called by CPU 13, at step S13, CPU 13 confirms that the number n of elements of array CHR (k), SPC (k) is 0. In general, the upper limit ($0 \leqq n \leqq M$) of effective elements in each array is stored in n. However, 0 is stored in the case where previous data is not used, such as, immediately after power-on, immediately after exchange of ink ribbon cassettes 24, immediately after exchange of print wheels 22, or the like. After confirmation, the procedure goes to step S24 when $n=0$. The procedure otherwise goes to step S14 to carry out the ordinary processing.

When $n=0$, at step S24, CPU13 cannot specify the precedingly printed character. CPU 13 stores ordinary feeding amount P for one character in SPC (0), and returns to the main routine.

When n is other than 0, at step S14, as initialization for a loop of step S15 and the succeeding steps, CPU 13 substitutes 0 and 1 for SPC (0) and a loop counter value k, respectively.

At step S15, CPU 13 determines whether the loop counter value k is equal to the number n of elements in the array. When the loop counter value k is not equal to the number n of elements in the array, the procedure goes to step S16. When they are equal, the procedure goes to step S22.

When the loop counter value k is not equal to the number n of elements in the array, at step S16, CPU 13 substitutes a value of SPC (k) found in each array update subroutine, to be described later, plus msp (CHR (k), CHR (0)) found from the above-described space table for variable s. SPC (k) is a relative position of a character printed k times before with respect to a position of a character printed immediately before, and msp (CHR (k), CHR (0)) is the minimum feeding amount of ink ribbon 21 required for a character printed k times before not overlying a character to be printed next. Therefore, if a character to be printed next is positioned at a relative position of a value larger than s, that is, a sum of SPC (k) and msp (CHR (k), CHR (o)) values, a character printed k times before will not overlie a character to be printed next on ink ribbon 21.

On the other hand, when the loop counter value k is equal to the number n of elements in the array, at step S22, CPU 13 checks an overflow flag v. When the overflow flag v is 0, the loop counter value k does not overflow. The procedure goes to step S16, and continues the ordinary processing. When the overflow flag v is 1, the loop counter value k overflows. Since data of characters printed $(n+1)$ or more times before is unknown, the procedure goes to step S23. At step S23, CPU 13 substitutes for s SPC (n), which is a relative position of a character printed n times before with respect to a position of a character printed immediately before plus ordinary feeding amount P for one character, so that characters printed n or more times before will not overlie a character to be printed next.

After the processing of steps S16 and S23 is completed, at step S17, CPU 13 compares feeding amount SPC (0) of the ink ribbon to be fed next found previously in the processing loop from step S15 to step S20 with s found at present at the preceding step. When s is smaller than SPC (0), at step S18, the value of s is substituted for SPC (0), and the value of SPC (0) is updated. On the other hand, when s is SPC (0) or less, if ink ribbon 21 is fed based on the value of SPC (0) already found, a character to be printed next will not overlie a character printed before. Therefore, the procedure skips step S18 to go to step S19.

At step S19, CPU 13 compares a value of feeding amount SPC (0) of ink ribbon 21 to be fed next minus a relative position SPC (k) of a character printed k times before with ordinary feeding amount P for one character. If the value is smaller than P, there is a possibility that characters printed $(k+1)$ or more times before will overlie a character to be printed next. Therefore, in order to consider characters printed $(k+1)$ or more times before, the procedure goes to step S20. On the other hand, the value is P or more, there is no possibility that characters to be printed k or more times before will overlie a character to be printed next. Therefore, it is not necessary to consider characters to be printed k or more times before. At this time, the procedure goes to step S25. CPU 13 resets the overflow flag v, and substitutes a value of $k-1$ for n as the upper limit number of elements in the array to be considered in the next processing, to return to the main routine.

Finally, at step S20, CPU 13 determines whether the loop counter value k is equal to the number n of elements in the array. When k is not equal to n, it is necessary to consider characters to be printed (k+1) or more times before. The procedure goes to step S21. At step S21, CPU 13 increments the loop counter value k, and returns to step S15. CPU 13 repeats steps S15 to S20 in order to consider characters to be printed (k+1) or more times before.

Accordingly, the minimum feeding amount SPC (0) is found such that all characters from a character printed immediately before to a character printed n times before do not overlie a character to be printed next on ink ribbon 21.

Description will now be given of each array update processing with reference to the flow chart of FIG. 9.

In response to each array update subroutine called by CPU 13, at step S26, CPU 13 compares the number n of elements in the array with the maximum number M of elements in the array. When n is equal to M, n reaches the upper limit. Therefore, the procedure goes to step S32, and CPU 13 sets the overflow flag v. On the other hand, when n is not equal to M, n does not reach the upper limit. In order to continue the ordinary processing, the procedure goes to step S27, and CPU 13 increments n to increase the number of elements in the array.

After the processing of steps S27 and S32 is completed, at step S28, CPU 13 substitutes the number n of elements in the array for the loop counter value k, and carries out initialization for a loop of step S29 and the succeeding steps.

At step S29, a value of each array is updated. At next printing, a character printed k times before is a character printed (k−1) times before. The relative position SPC (k) of a character printed k times before takes a value of the relative position SPC (k−1) of a character printed (k−1) times before minus feeding amount SPC (0) of the ink ribbon fed at step S10 of FIG. 7. CPU 13 stores CHR (k−1) in CHR (k), and stores a value of SPC (k−1) minus SPC (0) in SPC (k).

Figure 10:
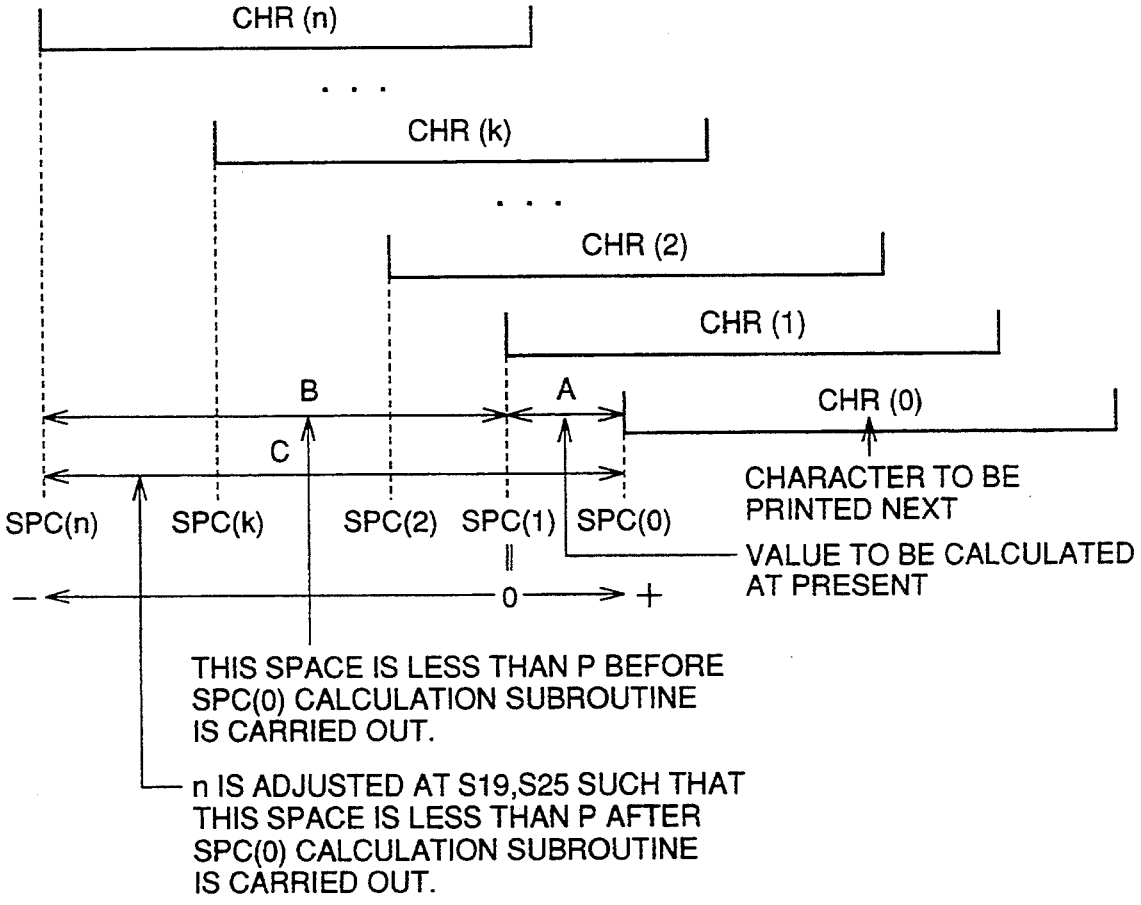
FIG. 10 is a diagram for explaining an array SPC found by each array update subroutine.

At step S30, CPU 13 decrements the loop counter value k. After decrement, at step S31, CPU 13 determines whether the loop counter value k is 0. When k is 0, the procedure returns to the main routine. When k is not 0, update of the array is not completed. Therefore, the procedure returns to step S29 and CPU 13 repeats from steps S29 to S31 until k is 0. FIG. 10 shows the relationship between a value of each SPC found by the above processing and a character printed. In the figure, the left end of a character printed is regarded as the character position. As shown in FIG. 10, the left of the position of SPC (1) is the − direction and the right thereof is the + direction with SPC (1) used as a reference value 0. Each SPC is stored as its relative position with respect to SPC (1) used as a reference. In the figure, A is a feeding amount of ink ribbon 21. It is adjusted at steps S19 and S25 so that B is less than ordinary feeding amount P for one character before carrying out the SPC (0) calculation routine, and that C is less than P after carrying out the routine.

Figure 11:
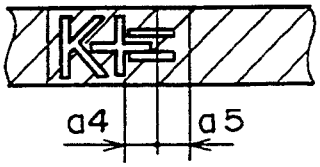
FIG. 11 is a diagram showing a state of an ink ribbon used by the printing apparatus of one embodiment of the present invention.
Figure 12:
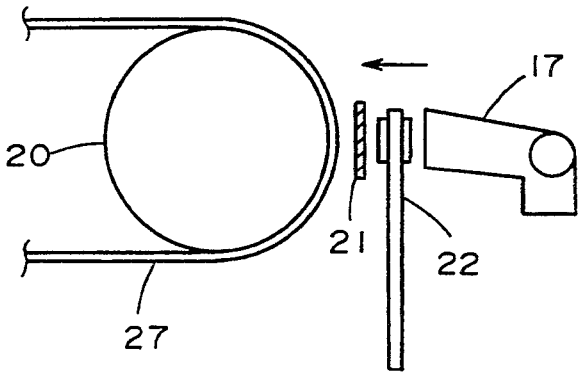
FIG. 12 PRIOR ART
FIG. 12 is a schematic diagram of a printing mechanism of a conventional printing apparatus.
Figure 13:
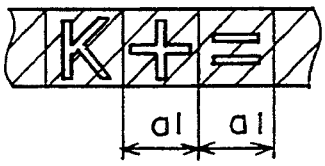
FIG. 13 PRIOR ART
FIG. 13 is a diagram showing a state of an ink ribbon used by the conventional printing apparatus.
Figure 14:
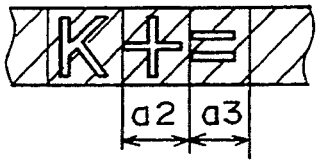
FIG. 14 PRIOR ART
FIG. 14 is a diagram showing a state of an ink ribbon used for printing by a PS pitch system.

FIG. 11 shows one example of the state of ink ribbon 21 when printing is actually carried out by the above-described printing method. As shown in FIG. 11, "+" and "=" are printed with ink ribbon 21 fed by feeding amounts of a4 and a5, respectively. Effective use is made of ink ribbon 21 completely.

In the second printing method, ink ribbon 21 is fed by such a minimum feeding amount that characters printed before will not overlie a character to be printed next, taking into consideration all of M characters printed before at maximum. As a result, it is possible to use ink ribbon 21 effectively.

Although an ordinary ink ribbon is used in the above embodiments, any printing transfer material such as a correction tape can be used with the similar effects.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing apparatus carrying out printing with a printing transfer material, comprising:

transfer means for transferring shapes from said printing transfer material;

traveling-amount-calculating means for calculating, using data stored in a memory, such a minimum feeding amount of said printing transfer material that none of a plurality of said shapes previously transferred by said transfer means overlaps a location, on said printing transfer material where a shape to be transferred next will be located; and traveling means for displacing said printing transfer material, with respect to said transfer means, by a traveling amount prior to transfer of the shape to be transferred next, said travelling amount being calculated by said traveling-amount-calculating means using said data stored in said memory.

2. The printing apparatus as recited in claim 1, wherein said traveling-amount-calculating means includes first traveling-amount-calculating means, for calculating such a minimum first traveling amount that a shape transferred M times before, where M is an arbitrary integer number of characters, does not overlap, on said printing transfer material, a shape to be transferred next, said minimum first traveling amount being calculated for respective numbers up to M; and second traveling-amount-calculating means, for calculating, as a second traveling amount, the largest traveling amount, out of the first traveling amounts calculated for respective numbers up to M by said first traveling-amount-calculating means, said traveling means displacing said printing transfer material, with respect to said transfer means, by said second traveling amount, calculated by said second traveling-amount-calculating means.

3. The printing apparatus as recited in claim 2, wherein said traveling-amount-calculating means further includes control means controlling said first traveling-amount-calculating means, whenever a minimum third traveling amount indicates that a shape transferred an integer k times before, where M is an integer at least as large as k, does not overlap on said printing transfer material, a shape to be transferred next, so that said first traveling-amount-calculating means does not calculate minimum traveling amounts for shapes transferred k times before.

4. The printing apparatus as recited in claim 3, wherein said predetermined traveling amount includes an ordinary traveling amount by which said printing transfer material is traveled when a shape is transferred.

5. The printing apparatus as recited in claim 2, wherein said traveling amount calculating means further includes changing means for changing, when the first traveling amount calculated by said first traveling amount calculating means is larger than a predetermined traveling amount, said second traveling amount to said predetermined traveling amount.

6. The printing apparatus as recited in claim 3, wherein said predetermined traveling amount includes an ordinary traveling amount by which said printing transfer material is displaced when a shape is transferred.

7. The printing apparatus as recited in claim 2, wherein said traveling amount calculating means further includes limiting means for limiting, when such a minimum third traveling amount of said printing transfer material that a shape transferred k ($M \geqq k$) times before does not overlap a shape to be transferred next on said printing transfer material is larger than a predetermined traveling amount, the number of the first traveling amounts to be calculated next by said first traveling amount calculating means up to k.

8. The printing apparatus as recited in claim 7, wherein said predetermined traveling amount includes an ordinary traveling amount by which said printing transfer material is displaced when a shape is transferred.

9. The printing apparatus as recited in claim 2, wherein said first traveling amount calculating means further includes setting means for setting, when a shape transferred k ($M \geqq k$) times before is not specified, a predetermined traveling amount as said first traveling amount.

10. The printing apparatus as recited in claim 9, wherein said predetermined traveling amount includes an ordinary traveling amount by which said printing transfer material is displaced when a shape is transferred.

11. The printing apparatus as recited in claim 2, wherein said first traveling amount calculating means includes storing means for storing in advance such a minimum third traveling amount that first and second shapes to be transferred do not overlap each other on said printing transfer material, and third traveling amount calculating means for calculating said first traveling amount by reading out from said storing means a third traveling amount corresponding to a shape transferred M times before and a shape to be transferred next.

12. The printing apparatus as recited in claim 1, wherein said printing transfer material includes an ink ribbon.

13. The printing apparatus as recited in claim 1, wherein said printing transfer material includes a correction tape correcting a transferred shape.

14. The printing apparatus as recited in claim 1, wherein said printing apparatus includes a typewriter.

15. The printing apparatus as recited in claim 1, wherein said transfer means includes means having a plurality of projections provided with said predetermined shape for transferring said predetermined shape by pressing one of said projections against said printing transfer material.

16. The printing apparatus as recited in claim 1, wherein said traveling amount calculating means includes first traveling amount calculating means for calculating such a minimum traveling amount of said printing transfer material that a shape transferred immediately before does not overlap a shape to be transferred next on said printing transfer material.

17. The printing apparatus as recited in claim 16, wherein said first traveling amount calculating means includes storing means for storing in advance such a minimum traveling amount of said printing transfer material that first and second shapes to be transferred do not overlap each other, and second traveling amount calculating means for calculating said minimum traveling amount by reading out from said storing means the minimum traveling amount corresponding to a shape transferred immediately before and a shape to be transferred next.

* * * * *